US005515692A

United States Patent [19]

Sterber et al.

[11] Patent Number: 5,515,692

[45] Date of Patent: May 14, 1996

[54] POWER CONSUMPTION DETERMINING DEVICE AND METHOD

[75] Inventors: Frank W. Sterber, Farmingdale; Daniel R. Stettin, Bellmore, both of N.Y.

[73] Assignee: Long Island Lighting Company, Hicksville, N.Y.

[21] Appl. No.: 415,256

[22] Filed: Apr. 3, 1995

Related U.S. Application Data

[63] Continuation of Ser. No. 164,333, Dec. 9, 1993, Pat. No. 5,415,005.

[51] Int. Cl.[6] ..... F25D 21/06; H02J 3/00

[52] U.S. Cl. ..... 62/154; 307/35; 62/155

[58] Field of Search ..... 307/39, 34, 35, 307/52; 62/154, 155, 234, 231, 157, 156, 230

[56] References Cited

U.S. PATENT DOCUMENTS

| | | | |
|---|---|---|---|
| 3,862,430 | 1/1975 | Lenhart et al. | 307/35 |
| 4,104,888 | 8/1978 | Reedy et al. | 62/154 X |
| 4,123,792 | 10/1978 | Gephart et al. | 62/154 X |
| 4,125,782 | 11/1978 | Pollnow, Jr. | 307/35 |
| 4,156,350 | 5/1979 | Elliott et al. | 62/234 X |
| 4,168,491 | 9/1979 | Phillips et al. | 307/39 X |
| 4,251,988 | 2/1981 | Allard et al. | 62/155 X |
| 4,400,949 | 8/1983 | Kinoshita et al. | 62/140 |
| 4,916,328 | 4/1990 | Culp, III | 307/39 |

*Primary Examiner*—Harry B. Tanner
*Attorney, Agent, or Firm*—Dilworth & Barrese

[57] ABSTRACT

A device and method is provided for automatically defrosting a refrigeration system. The present invention includes a microprocessor which initiates a defrost cycle during a time of day which is most efficient for the refrigerator and the utility company. Moreover, the defrost cycle is initiated during a time of day which has the least impact on food stored within the microprocessor. The microprocessor is programmed and enabled so as to analyze the power consumption of the refrigerator during a 24 hour period, and from this analysis, the microprocessor is able to determine the time of day and period(s) of time which will be most efficient for the initiation of a defrost cycle.

20 Claims, 10 Drawing Sheets

FIG. 1 (PRIOR ART)
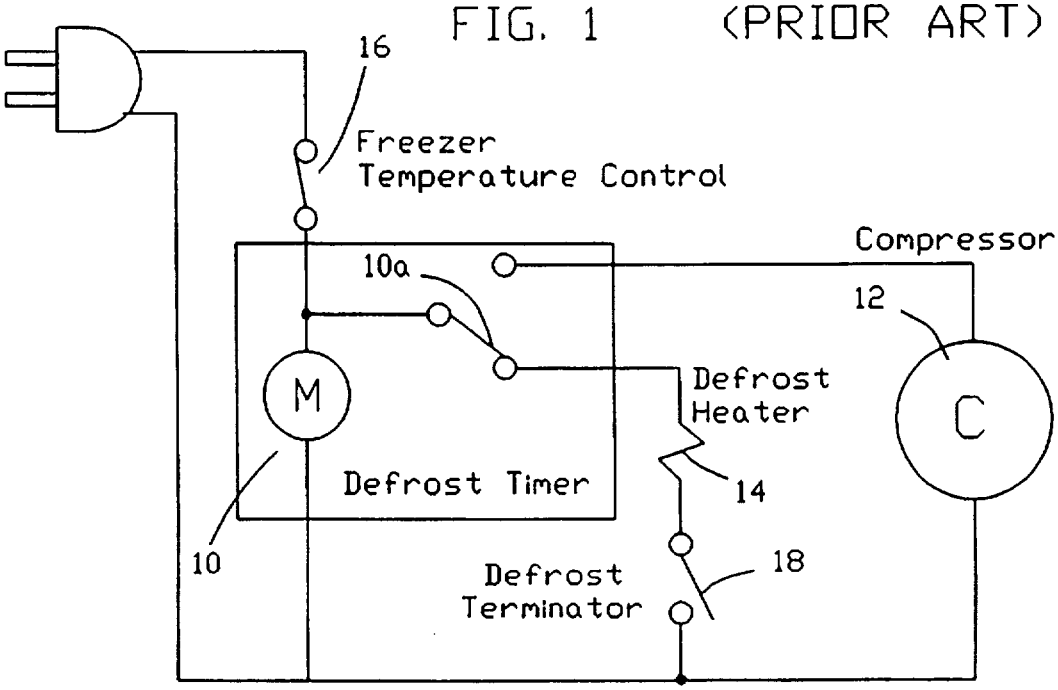
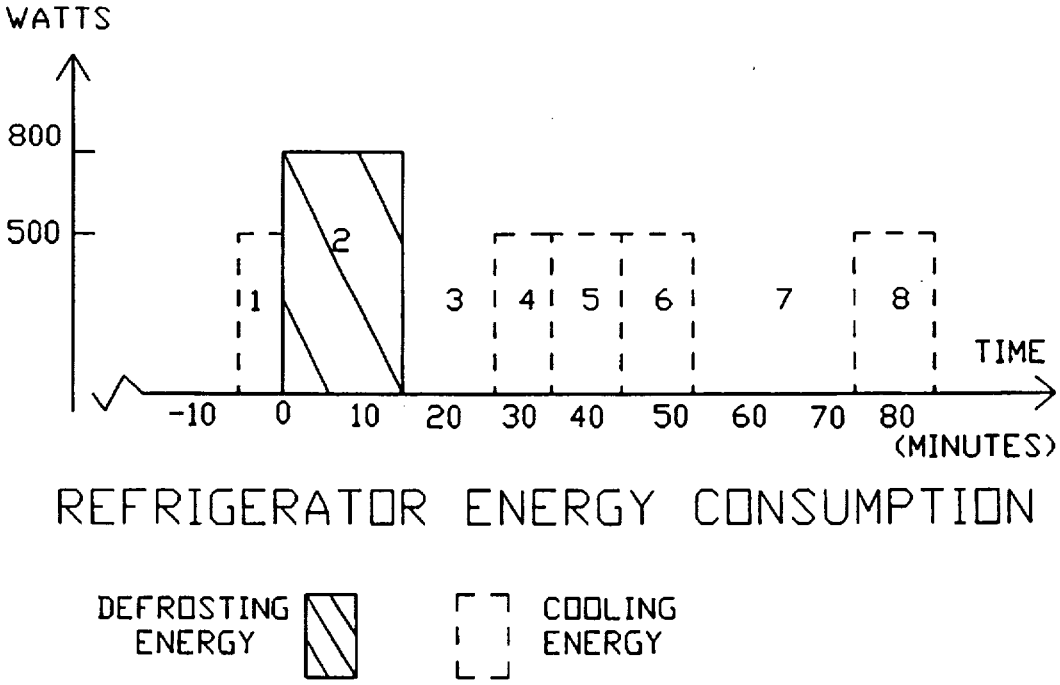
FIG. 2 (PRIOR ART)

ALTERNATIVE IMPLEMENTATION

POWER CONSUMPTION DETERMINING DEVICE AND METHOD

This is a continuation of application Ser. No. 08/164,333, filed on Dec. 9, 1993, U.S. Pat. No. 5,415,005.

BACKGROUND OF THE INVENTION

1. Field of the Invention

The present invention relates to a device for determining periodic power consumption of an electrically operated appliance and more particularly relates to a device and method for activating an electric component of the electrically operated appliance in response to the determined periodic power consumption of the electrically operated appliance.

2. Description of the Related Art

A refrigerator typically is provided with a defrosting control system for removing frost which has accumulated on the evaporator coils of a refrigerator during a cooling cycle. A typical defrosting control system is illustrated in FIG. 1 and generally includes a motor driven switch timer (10) which effectively counts the cumulative running time of a compressor (12) so as determine when the cooling cycle is to be terminated so as to initiate a defrosting cycle. The refrigerator circuit, including the motor driven switch timer (10), is activated when a freezer temperature control switch (16) closes, caused generally by the refrigerator having a storage compartment temperature above a prescribed value. When switch (16) opens, the refrigerator is in effect off. A defrost heater (14) is provided for thawing the frost accumulated on the evaporator coils (not shown) along with a defrost terminator (18) for detecting the temperature of the evaporator coils so as to disable the energization of the defrost heater (14).

The defrosting operation is controlled and carried out periodically by the motor driven switch timer (10) which is typically detachably coupled to the control circuitry of the refrigerator at quick-connect terminals to facilitate replacement if necessary. The duty cycle of refrigeration to defrost is fixed by the refrigerator manufacturer and implemented in the motor driven switch timer (10), with generally six hours of cooling to thirty minutes of defrosting. There are no adjustments to compensate for variations in the operating environment, and as such the same ratio is used in a refrigerator disposed in Alaska as compared to a refrigerator used in Florida.

In operation, when the freezer temperature control switch (16) closes, the cooling compressor (12) is activated, and the cumulative running time of compressor (12) is counted by the motor driven switch timer (10). After the compressor (12) has been energized for a prescribed period of time, such as, e.g., six hours, the motor driven switch timer (10) immediately de-energizes the compressor (12) and consequently energizes the defrost heater (14) through the provision of an internal switch (10*a*). The motor driven switch timer (10) thereafter enables the defrost heater (14) to be energized when the defrost terminator (18) is in a closed position. Typically, the defrost terminator (18) will be in a closed position when the temperature of the evaporator coils are below a prescribed value (e.g., 20° F.). In particular, the motor driven switch timer (10) enables the defrost heater (14) to be energized only during a defrosting duty cycle which is typically a thirty minute period which is prescribed by the motor driven switch timer (10). While the defrost heater (14) is energized, any frost on the evaporator coils are gradually thawed by radiant heat from the defrost heater (14). The accumulation of ice and frost on the evaporator coils restricts the coils from drawing heat out of the food compartment since the ice acts as an insulator, thus lowering the efficiency of the coils, and consequently, the refrigerator. In accordance with the energization of the defrost heater (14), the temperature of the evaporator coils gradually rises. In this time period, (such as, e.g., a half hour) the defrost terminator (18) detects the temperature of the evaporator coils. When the temperature of the evaporator coils reaches a prescribed value, (such as, e.g., 50° F.) the defrost terminator moves to an open position and the defrost heater (14) is deenergized, whereafter the compressor (12) is returned to an operational state by the motor driven switch timer (10) after the half hour duty cycle of the defrost heater (14) has expired.

In typical refrigerator control systems, such as illustrated in FIG. 1, the motor driven switch timer (10) only operates when the refrigerator's settable freezer temperature control switch (16) is closed (usually when the temperature in the storage compartment of the refrigerator is above a prescribed temperature, e.g., 50°). As illustrated in FIG. 2, a defrost cycle must always interrupt and supersede a cooling cycle. Further, the cooling cycle may not be resumed, (regardless of the position of the defrost terminator (18), until after the defrost duty cycle, as prescribed in the motor driven switch (10), has expired. FIG. 2 illustrates a refrigerator energy consumption graph including a defrost cycle consisting of thirty minutes which comprises regions (2) and (3). Only after expiration of the defrost duty cycle, may the motor driven switch timer (10) initiate a cooling cycle, as indicated by regions (4),(5) and (6) in FIG. 2, and as seen, during region (3) the refrigerator is effectively off.

The above defrost scheme is disadvantageous in that the defrost cycle is only initiated by the interruption and consequent termination of a cooling cycle. This results in a high energy consumption by the refrigerator along with the degradation of food stored within the refrigerator. In particular, the refrigerator consumes a large amount of energy since the compressor must not only lower the temperature of the storage compartment to below a prescribed temperature, but must now additionally compensate for the further rise in compartment temperature which is attributable to the defrosting cycle. Thus, the further rise in the compartment temperature along with the longer time period required by the compressor to lower the compartment temperature, gives rise the degradation of food which may be stored within a storage compartment of the refrigerator.

Furthermore, it has been found that there are a greater number of cooling cycles, and cooling cycles of longer duration, required during times of high ambient temperatures and high door opening activity, (e.g., dinner time during a hot humid day in August) and less cooling cycles during lower ambient temperatures and low door opening activity, (e.g., 3 a.m. in the morning). Therefore, the existing defrost scheme utilized by refrigerators tends to drive initiation of a defrost cycle toward the power utility's peak load period. Additionally, more cooling cycles and cycles of long duration are required during brown outs or immediately following a power outage, and therefore, a high probability of a defrost cycle being initiated exists at those times. Thus, there is no relationship of initiation of the defrost cycle as to the amount of frost on the evaporator coils, since the defrost cycle is not altered based on how much ice is melted, and the initiation time of the defrost cycle is unrelated to the needs of the power utility company.

A typical example of the above method is disclosed in U.S. Pat. No. 4,528,821 to Tershak et al. wherein the defrost cycle is executed while the operation of the cooling cycle is switched from the "on" state to the "off" state or during a period when the temperature within the refrigerator is at the upper end of its range at which foods deteriorate.

A still further type of defrost control is disclosed in U.S. Pat. No. 4,251,988 to Allard et al. This defrost control is referred to as an "adaptive" defrost control since it establishes the time between succeeding defrosting cycles as a function of the length of time that the defrost heater was energized during the first defrosting cycle. Another type of adaptive defrost control is disclosed in U.S. Pat. No. 4,481,785 to Tershak et al. This adaptive defrost control varies the length of an interval between defrosting cycles in accordance with the number and duration of compartment door openings, the duration of a previous defrosting cycle as corrected by the temperature of the evaporator coils prior to a defrost cycle and the length of time the compressor has been energized. However, the decrementing of the number and duration of refrigerator door openings does not result in an entirely accurate representation of the amount of frost which has formed on the evaporator coils due to the moisture introduced into the refrigerator while the refrigerator door is open. Accordingly, this results in a less-than-optimal defrost interval.

Thus, a common disadvantage with prior defrost systems is that they do not initiate a defrost cycle during an optimal time period according to the energy efficiency of the refrigerator, the peak demand loading needs of power utility companies and the degradation of food caused by a defrosting cycle being initiated during a warm ambient temperature period.

Furthermore, the above mentioned adaptive defrost controls are unable to be readily adapted for retrofit into existing refrigerator control systems. Rather, the control circuitry of refrigerators must be designed and configured for the implementation of such adaptive defrost controls.

Accordingly, there exists a need to provide a defrost system that will conserve energy and prevent the degradation of food by initiating a defrost cycle during an optimal time period which is most energy efficient after the completion of a cooling cycle.

It is an object of the present invention to initiate a defrosting cycle in a refrigerator during an off-peak demand period of utility companies which is most energy efficient for the refrigerator while also preventing the degradation of food stored within the refrigerator.

Further, there exists a need to provide a defrost control system that is configured to be readily adapted into existing refrigerators while being simple and inexpensive to manufacture.

SUMMARY OF THE INVENTION

Generally, in a refrigeration system, a compressor provides for cooling the food compartment in conjunction with evaporator coils which draw heat out of the food compartment to assist the compressor in the cooling function. During cooling, frost and ice tend to accumulate on the evaporator coils which decreases the efficiency of the refrigerator. It is desirable to defrost the accumulated frost and ice only as often as is necessary to maintain an efficient cooling system. This objective dictates that a balance be struck between the competing considerations of system operation with frosted evaporator coils, the energy consumed in removing a frost load from the evaporator coils and the acceptable level of temperature fluctuation within the refrigerated food compartments as a result of a defrosting operation.

To accomplish the objects described above, the present invention provides a novel defrost control device which is dimensioned and configured so as to be detachably engaged with the refrigeration components of a commercially available refrigerator. Typically, a commercially available refrigerator comprises at least one enclosed compartment for storing items, such as food. Means for cooling the at least one enclosed compartment, such as a compressor and evaporator, are also typically provided. Additionally means are provided for heating the evaporator, (i.e., a defrost heater) so as to remove accumulated frost from the evaporator.

The novel control device is configured so as to initiate a defrost cycle, whereby the initiation of the defrost cycle is responsive to the daily power consumption of the refrigerator. In particular, the control device of the present invention includes a microprocessor which is preprogrammed with a mathematical scheme so as to determine the time of day without the usage of clock by analyzing the energy consumption of the refrigerator during a 24 hour period.

By determining the approximate time of day, the microprocessor is enabled to initiate a defrost cycle during the off-peak energy power consumption time of the local utility company. This is advantageous since the off-peak energy power consumption time typically coincides with the time period corresponding to the period of least usage of the refrigerator (the opening and closing of doors). Further, this time period coincides with a relatively low ambient temperature which the refrigerator will be exposed to during a 24 hour period. Thus, the initiation of a defrosting cycle during this time period conserves energy while also having the smallest impact on food stored within the refrigerator. The microprocessor can anticipate the initiation of the next cooling cycling starting a defrost cycle just prior to the predicated start thus, a cooling cycle will never be interrupted. Furthermore, the microprocessor constantly monitors the operating frequency of the defrost heater so as to ensure that a defrost cycle is only initiated when it is needed and only during a time period which is most efficient for the refrigerator and the local utility company.

BRIEF DESCRIPTION OF THE DRAWINGS

Further features of the present invention will become more readily apparent from the following detailed description of the invention taken in conjunction with the accompanying drawings, in which:

FIG. 1 is a simplified schematic circuit illustrating a refrigerator circuit utilizing a prior art defrost time which is used to defrost the refrigerator;

FIG. 2 is a graph illustrating the energy consumption of a refrigerator having a circuit using the prior art defrost timer of FIG. 1;

DETAILED DESCRIPTION OF THE PREFERRED EMBODIMENT

Figure 3:
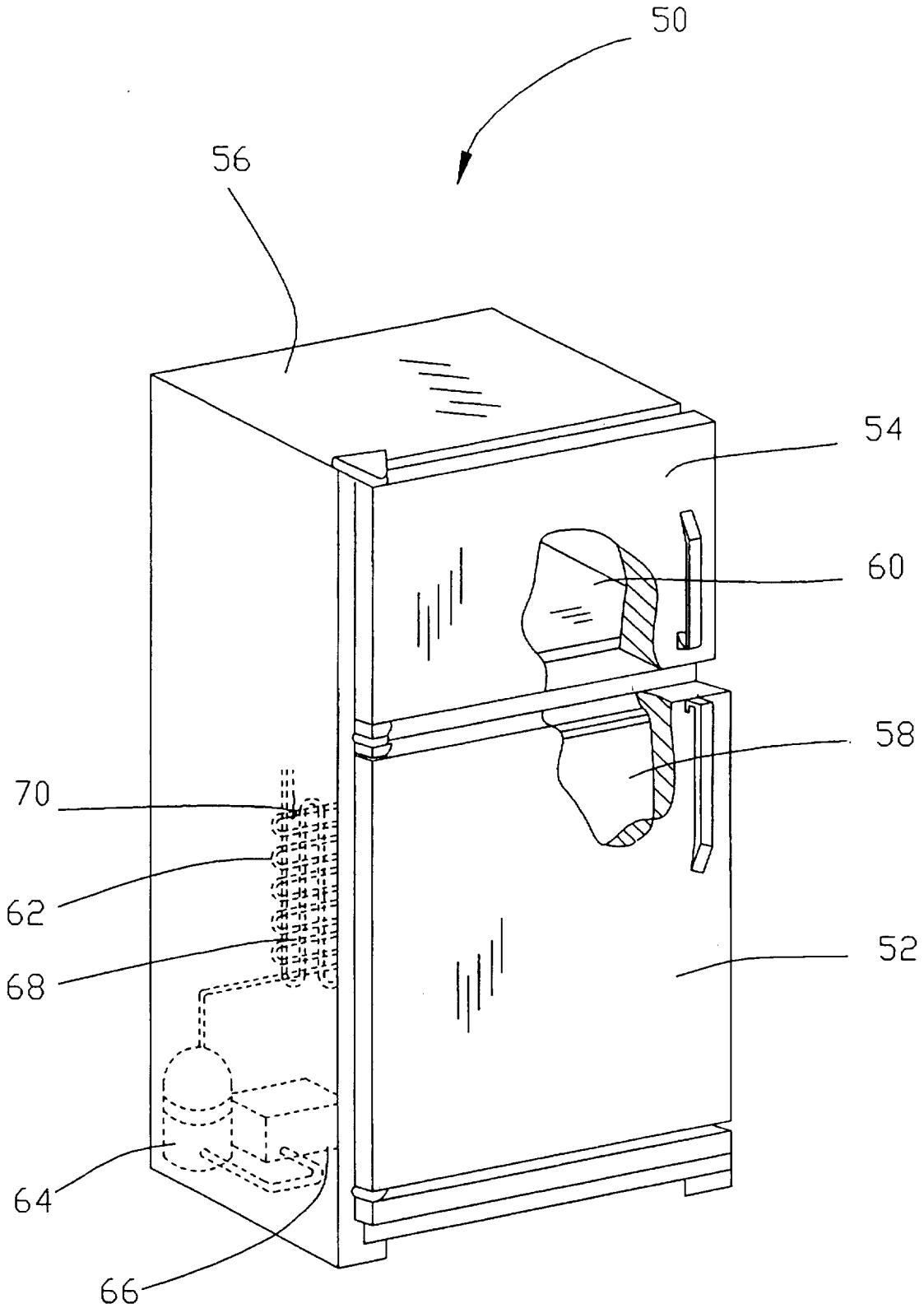
FIG. 3 is a perspective view of a refrigerator in partial cut-away illustrating components of the refrigerator with which the present invention is used.

Referring now to FIG. 3, there is illustrated a refrigerator 50 within which the present invention is intended to be used with. Generally, such a refrigerator 50 includes a fresh food compartment door 52 and a frozen food compartment door 54 which are pivotably connected to a body portion 56 which defines, respectively, a fresh food compartment 58 and a frozen food compartment 60.

The respective food compartments 58, 60 are refrigerated by passing refrigerated air therein which is cooled by a cooling apparatus which comprises an evaporator 62, a compressor 64 and a condenser 66. The cooling apparatus also includes a condenser fan, an evaporator fan and a heater or accumulator (not shown), as is conventional.

The evaporator 62 is periodically defrosted by a defrost heater 68 which is to be operated by the control of the present invention. The defrost heater 68 may be configured as of the ordinary resistive type or may be configured as any other type of heating element configured to accomplish such a task.

A temperature sensing device generally in the configuration of a defrost terminator 70 (such as, i.e., a thermostat) is disposed in heat-transfer relationship with the evaporator 62. More specifically, the defrost terminator 70 is mounted directly on the evaporator 62 as to detect the temperature thereof. Additionally, at least one temperature control switch (not shown) is utilized in at least one food compartment 58, 60 so as to detect the temperature of one or both of the respective food compartments 58, 60.

Figure 4:
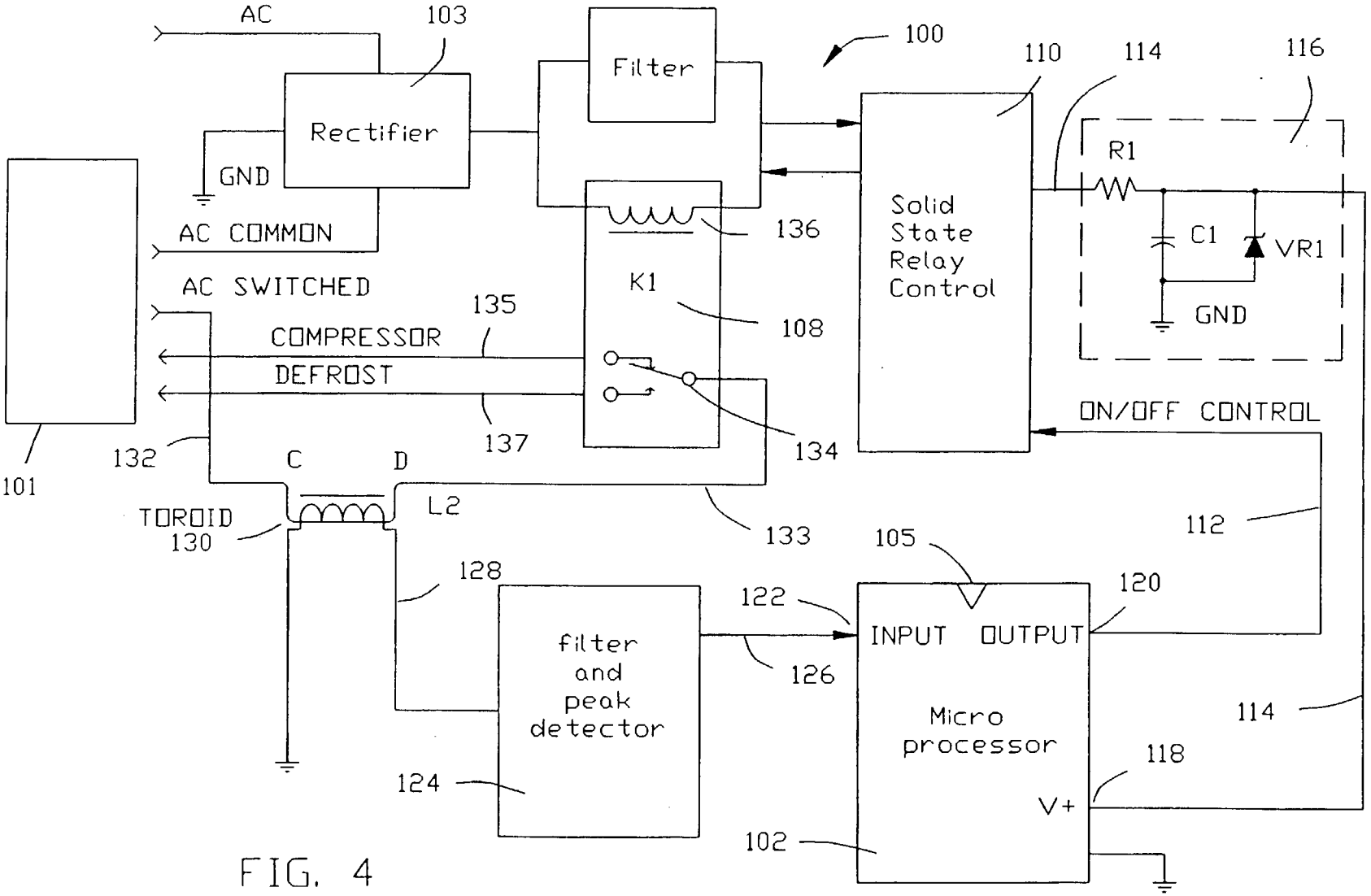
FIG. 4 is a schematic circuit diagram illustrating a defrost control system according to the present invention.

Turning now to FIG. 4, there is illustrated a schematic circuit diagram of the control system 100 according to the present invention, which is constructed to replace the prior art electromechanical timer (1) as shown in the circuit of FIG. 1. The control system 100 is preferably disposed within the body portion 56 or outside of the body portion 56 of the refrigerator 50. As described in more detail below, the control 100 is configured to detachably engage with the above-mentioned components of an existing refrigerator 50 (FIG. 3), such as that shown in FIG. 4 and schematically depicted as block 101.

In general, the control 100 comprises a microprocessor 102 together with circuitry for controlling the compressor 64 and the defrost heater 68 of the refrigerator 50. The microprocessor is provided with a clock input 105 configured to connect to a clock source, such as an oscillator (not shown), as is conventional.

Figure 5:
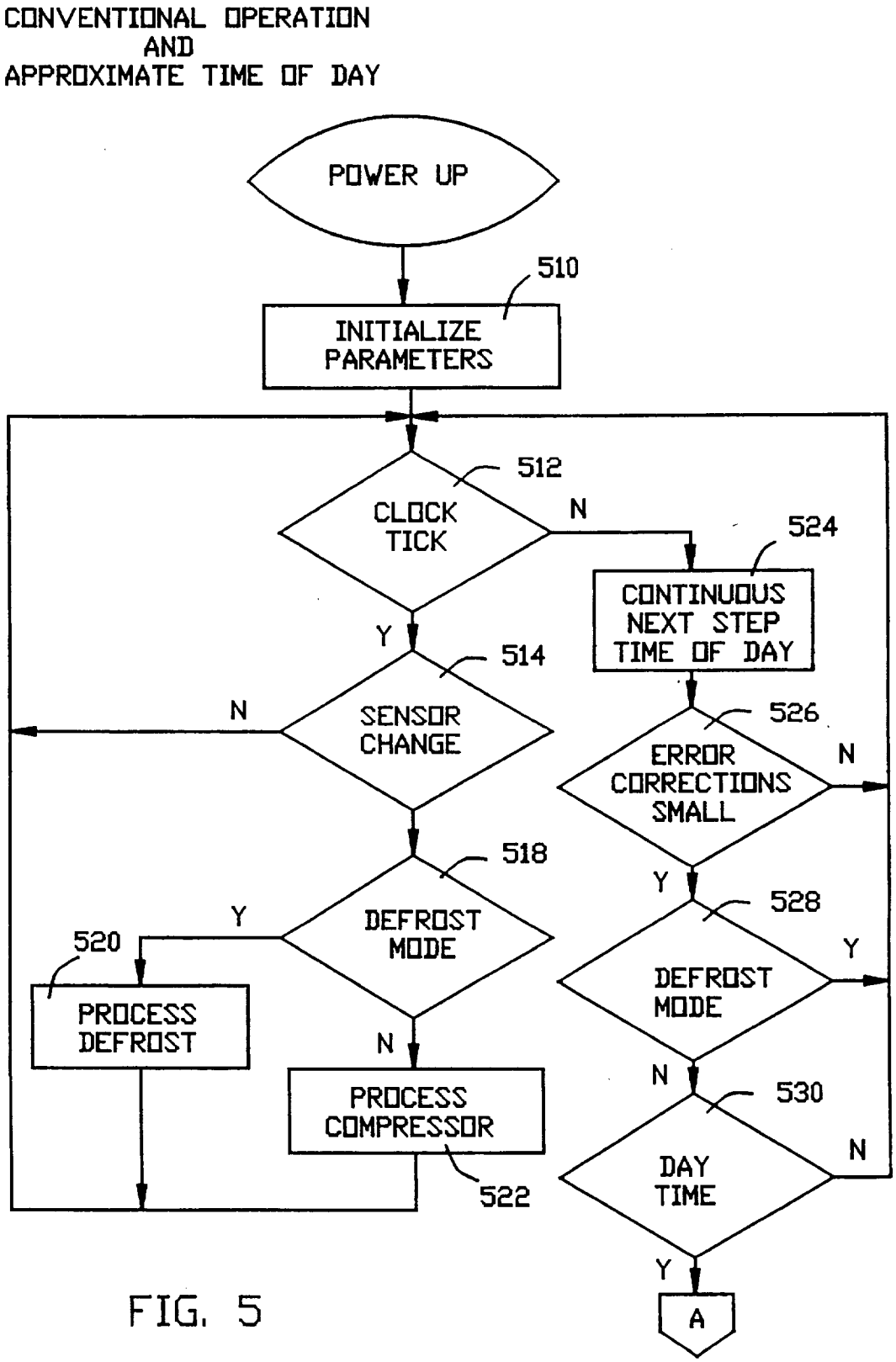
FIGS. 5–12 are flow charts explaining the operation of the microprocessor of FIG. 4.

Further, the microprocessor 102 samples the AC line, via resistor R2, to obtain precise time periods, designated "ticks" block 512 as illustrated in FIG. 5 and further discussed below.

The various components of the control 100 illustrated in FIG. 4 receive DC voltage from a rectifier 103 which is directly coupled, via line 104, to an AC voltage source. In particular, the AC voltage source may originate from the power circuitry of the refrigerator 50 or from any other source, such as a conventional wall outlet. A filter apparatus 106 is coupled to the rectifier 103 so as to reduce the ripple of the terminal voltage from the rectifier 103, and additionally, to smooth out any voltage surges being effectuated from a compressor/defrost relay 108 being coupled in parallel relationship to the filter 106. The compressor/defrost relay 108 comprises a dry switch 134 and a relay coil 136, the significance of which will be described in greater detail below.

A solid state relay control 110 couples to the filter apparatus 106 and to the compressor/defrost relay 108. The solid state relay control 110 is configured to either energize or de-energize the compressor/defrost relay 108 upon a command signal which is generated from the output terminal 120 of the microprocessor 102 which is coupled, via line 112, to the solid state relay control 110.

The microprocessor 102 is powered by line 114 which is coupled from rectifier 103. A zener diode DC regulated power supply 116 is provided in line 114 so as to regulate the voltage between the rectifier 103 and the input supply voltage terminal 118 of the microprocessor 102.

An input terminal 122 of the microprocessor 102 is coupled, via line 126, to a filter and peak detector 124. The filter and peak detector 124, via line 128, is coupled to a toroid transformer 130. As will be described in greater detail below, the filter and peak detector 124 provides the microprocessor 102 with the information which in turn is utilized by the microprocessor so as to formulate when a defrosting cycle is to be initiated in the refrigerator 50.

The toroid transformer 130, via line 132, is in electrical communication with an AC switched line voltage supply of the refrigerator 50. Specifically, the AC switched line voltage supply, via line 132, provides an energizing current when the temperature control switch of the refrigerator 50 is in a closed position. Typically, the temperature control switch is in a closed position when a respective food compartment 58, 60 of the refrigerator 50 has a temperature which is greater than a prescribed value (such as, e.g., 30° F.). Conversely, when a respective food compartment 58, 60 of the refrigerator 50 has a temperature which is less than the above mentioned prescribed value, the temperature control switch moves to an open position so as to prevent an energizing current to flow from the AC switched line voltage supply to the line 132 of the control system 100.

As mentioned above, the compressor/defrost relay 108 comprises a dry switch 134 and a relay coil 136. The line 133 is coupled to the dry switch 134. The dry switch 134 is configured to be actuable by a command signal from the microprocessor 102, via the relay coil 136. The dry switch 134 is actuable between an activated position and a de-activated position. When the dry switch 134 is de-activated, it effectively couples the AC switched line voltage supply by line 135 to the compressor 64 of the refrigerator 50. Conversely, when the dry switch 134 is activated, it effectively couples the AC switched line voltage supply by line 137 to the defrost heater 68 of the refrigerator 50. It is particularly noted that the dry switch 134 may only be switched from the de-activated position to the activated position when the compressor 64 is not energized (generally when a temperature control switch is disposed in an open position, as mentioned above).

The toroid transformer 130 is configured to sense the flow of energizing current, via lines 132 and 133, from the AC switched line voltage supply of the refrigerator 50 to the dry switch 134 of the compressor/defrost relay 108. Thus, when the temperature control switch of the refrigerator 50 is disposed in a closed position, the toroid transformer 130 effectively detects the flow of energizing current from the AC switched line voltage supply, via line 132, to either the compressor 64 or the defrost heater 68, depending upon the position of the dry switch 134. The toroid transformer 130 couples this sensed energizing current flow, via line 128, to the filter and peak detector 124.

The filter and peak detector 124, via line 126, is coupled to an input terminal of the microprocessor 102. As will be discussed in much greater detail below, the microprocessor 102 processes this received information from the filter and peak detector 124, and subsequently formulates when it is most efficient to initiate a defrosting cycle in the refrigerator 50.

When the microprocessor 102 determines that a defrost cycle should be initiated, an "ON" signal is sent from the output terminal 120 of the microprocessor 102 to the solid state relay control 110. The solid state relay control 110 relays the "ON" signal to the relay coil 136 of the compressor/defrost relay 108 which effectuates the dry switch 134 to be "activated", thereby enabling the AC switched line voltage supply to be coupled to the defrost heater 68 of the refrigerator 50.

In contrast, when the microprocessor 102 determines that the defrost cycle is to be terminated, an "OFF" signal is sent from the output terminal 120 of the microprocessor 102 to the solid state relay control 110. The solid state relay control 110 relays the "OFF" signal to the relay coil 136 of the compressor/defrost relay 108 which effectuates the dry switch to be "de-activated", thereby enabling the AC switched line voltage supply to be coupled to the compressor 64 of the refrigerator 50.

Referring now to FIGS. 5–12, there is illustrated a flow chart of the programming utilized the programming of the microprocessor 102 for implementing the control of the instant invention.

The microprocessor program starts immediately after the completion of power on reset timing circuit (not shown).

The parameters of APC (Actual Recorded Hourly Power Consumption), TTDC (Time to Defrost Control), defrost mode, various recorded times, Tdefrostactual, defrost time and others not described, are initialized (step 510). During the first days (e.g. five days) of operation while the proposed device is determining the operational time of day for the refrigerator, it will operate as a conventional defrost timer. The defrost period will be fixed at a 13 hour elapsed time period or, if an alternate configuration is implemented, jumpers positioned within the microprocessor circuity will be read by the microprocessor for various common time periods such as 6, 8, 12, and 16 hours. Referring to FIG. 5, a clock in the microprocessor is initially set for zero (step 500) and will start counting when a tick occurs after every 1 second of the system clock event. If a tick is detected, the control system 100 will measure the toroid current sensor 130 and determine if the current in the defroster or compressor has changed state (steps 512 and 514). If no change in the measured current is detected, the system repeats steps 512 and 514 until a current change is detected. Once a current change is detected, a defrost mode flag is read to determine if the change detected occurred while the defrost heater was energized or the compressor was energized (steps 516 and 518). If the defrost mode flag was set the defrost process of FIG. 6 is performed (step 520).

Figure 6:
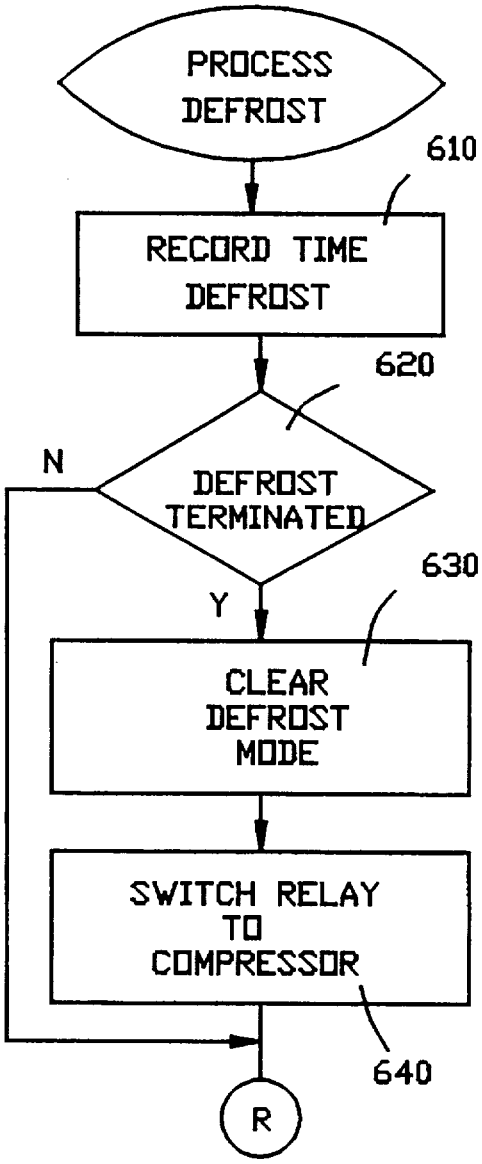

The defrost process, illustrated in FIG. 6, is implemented such that the microprocessor 102 records the defrost time, as referenced to the clock ticks (step 610) and reads the toroid current sensor 130 to determine if current is sensed (step 620). If current is sensed, the time recorded was a defrost start and the defrost process returns to the main loop (step 620 of FIG. 6 and step 520 of FIG. 5). If no current is sensed by the toroid current sensor 130, the time recorded was a defrost termination requiring the defrost mode flag to be cleared (step 630) and the dry switch 134 of the common relay contact 108 is switched to activate the compressor (step 640) so that the next time the refrigerator temperature control supplies power to the common relay contact 108 the compressor will actuate. Once the relay 108 is switched, the defrost process returns to the main loop at step 520 of FIG. 5.

Figure 7:
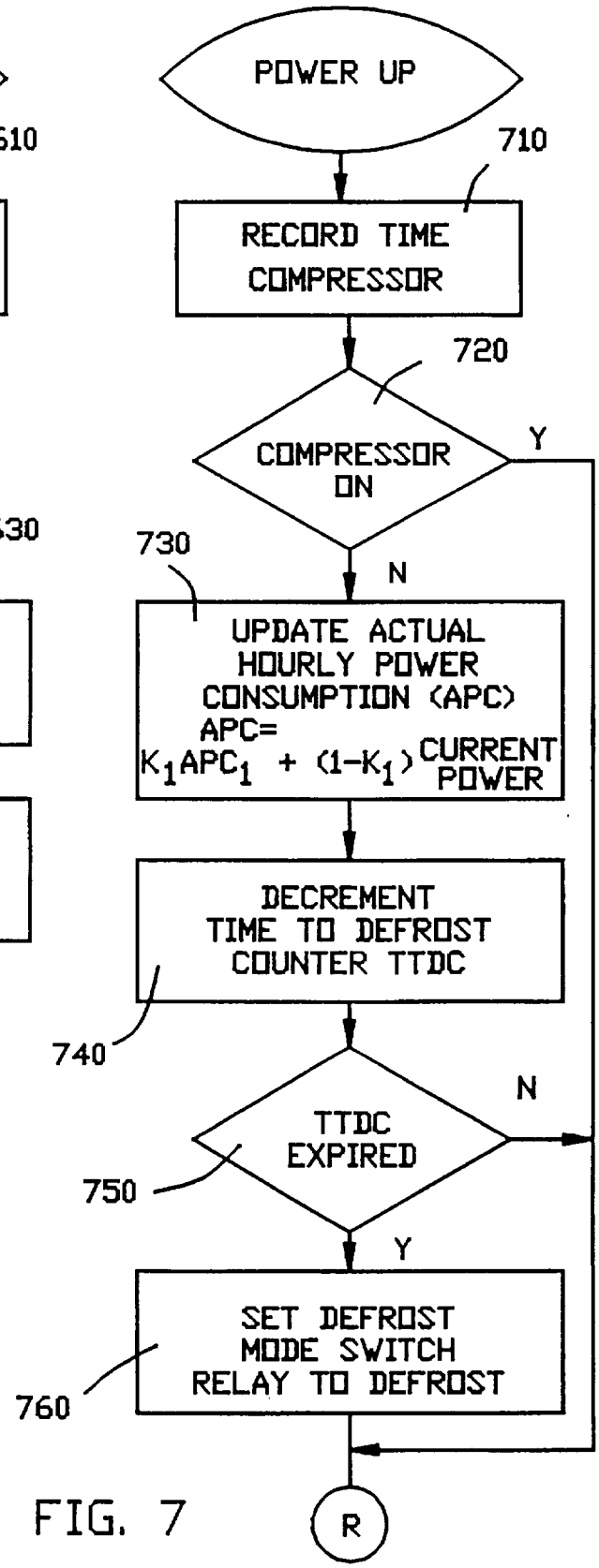

Returning to step 518 of FIG. 5, if the defrost mode flag is not set (step 518), the compressor process is performed (steps 518 and 522). The compressor process is illustrated in FIG. 7 and comprises the steps of recording the time (step 710) as being referenced to the clock ticks. The current sensor (step 720), via the toroid transformer 130 (FIG. 4), is read to determine if current is sensed. If current is sensed, time is recorded as a compressor start (step 720) and the compressor process returns to the common loop of FIG. 5 (steps 518 and 522). If no current is sensed, the time recorded is of compressor power consumption being terminated (step 730). The APC memory array contains a 24 hour record of averaged power consumption. The APC is updated with smoothing (step 740) by adding a percentage of the latest compressor power consumption to the complementary percentage K1 of the averaged power consumption for the respective time period. The TTDC counter is decremented (740) by an amount equal to the stop time minus the start time (compressor on duration). The TTDC counter is initially set to 13 hours, equivalent to approximately 8 hours of compressor run time as would be measured by a conventional timer, during the conventional defrost program operation. Other times may be selected if the alternate jumper configuration (not shown) is used. If the TTDC has expired, (step 750) the relay is switched to the defrost position (step 760) and a defrost will be initiated the next time the temperature control supplies power to the relay common terminal. If the TTDC has not expired, the program will not allow initiation of defrost at this time and the program returns to the common loop (steps 518 and 522).

Figure 8:
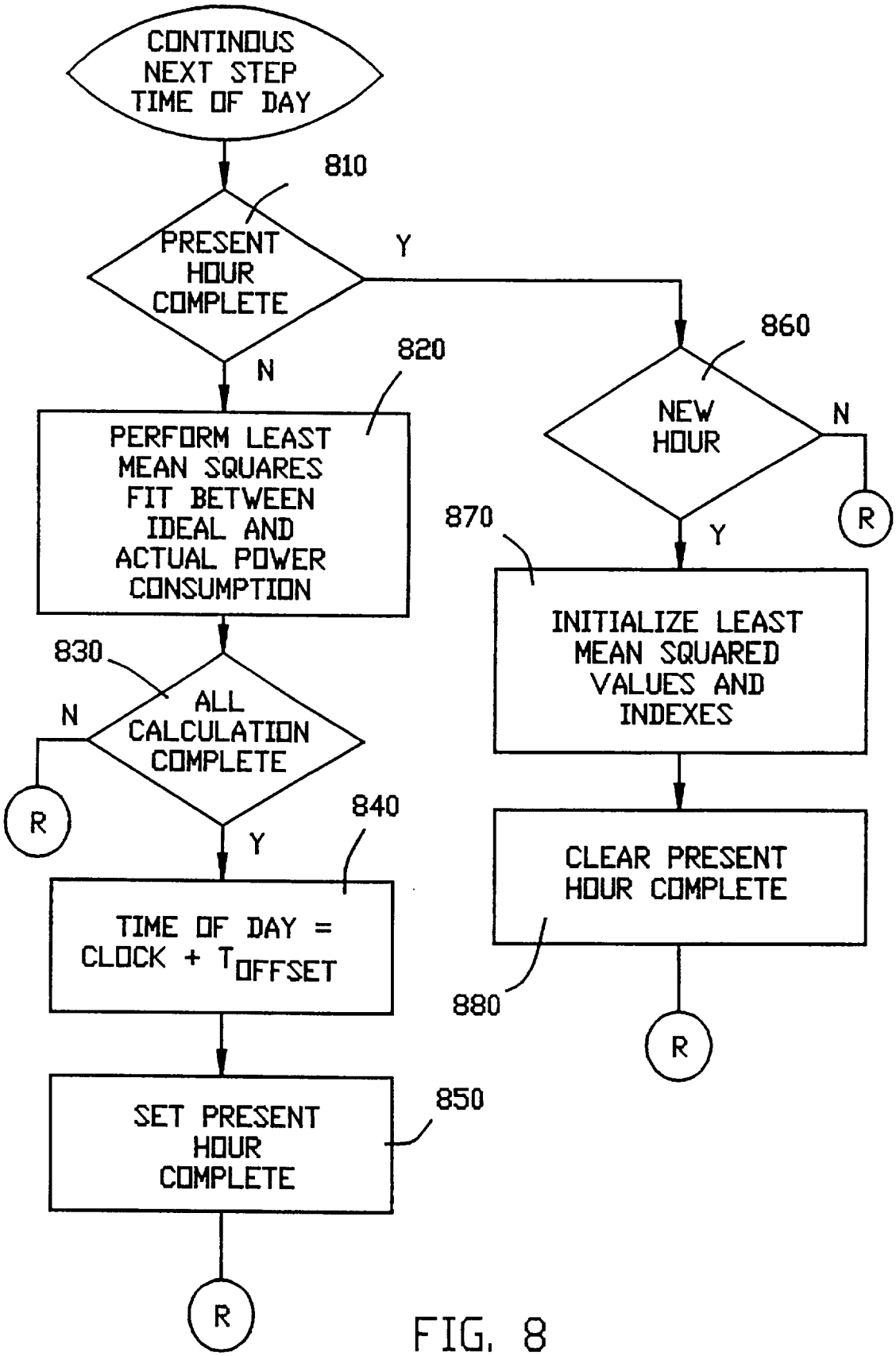

Returning to FIG. 5, if the clock has not ticked (step 512), the program determines if a Continuous Next Step Time of Day (524) is required. Turning to FIG. 8, the Present Hour Complete Flag is tested to determine if all calculations for the present hour are complete (step 810). If not, another single element of the 24 element typical hourly power consumption is subtracted from an element of the 24 element actual element power consumption array (step 820), the result squared and added to a running sum for the appropriate time element. This function (step 820) is the calculation of at least means square fit, also referred to as a correlation, of a mathematical representation of the typical hourly power consumption expected of a typical refrigerator in a typical family residence to that of the refrigerator containing the device 100 of the present invention.

As there are 24 by 24, or 576 calculations, only one calculation is performed per pass through the loop. If all 576 calculations are not complete (step 830) the program returns. If all are complete the program calculates the time of day by adding the time offset determined (step 820) to the clock (step 840). The present hour complete flag is set (step 850) and the program returns (step 526).

Referring to FIG. 8, if the Present Hour Complete Flag is set, there will be no more calculations until a new hour occurs (step 860). At the start of a new hour the indexes for the 576 calculations are initialized (step 870), the Present Hour Complete Flag is cleared (step 880) and the program returns to the common loop (step 526).

Returning to FIG. 5, as the amount of compressor power consumption data increases, the estimates of time of day will become closer to actual. When the error corrections to time of day become small (step 526), and the refrigerator is not in defrost mode (step 528) and there is sufficient time (step 530) until the middle of the off peak period, about 3 AM, the program is allowed to calibrate the defrost operation to determine the thermal overhead, as illustrated in FIG. 9.

Figure 9:
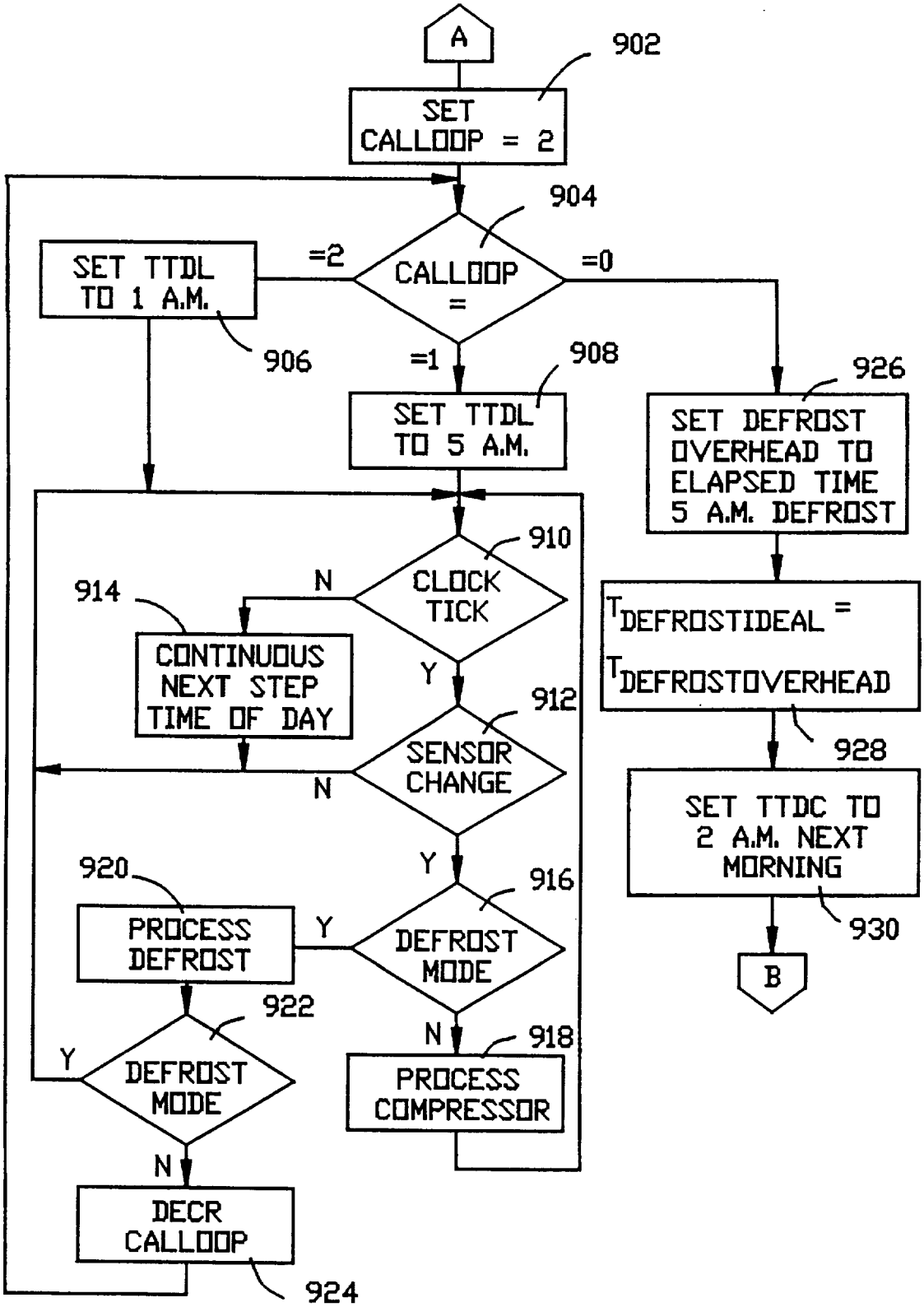

Referring to FIG. 9, the calibration process requires two defrosts closely spaced. The process is directed by a CAL-LOOP count (step 902). The first defrost is set to occur at 1

AM (step 906). While waiting for the defrost to occur, the clock ticks (step 910), sensor change (step 912) time of day calculations (step 914), defrost (steps 916 and 920), compressor (step 918) are utilized similarly to those in conventional operation mode (steps 512, 514, 518, 520 and 522). However, when the 1 AM defrost has completed (steps 922 and 924), CALLOOP is decremented to allow setup of the 5 AM defrost (step 908). Since only 4 hours of presumably little refrigeration activity exist between 1 and 5 AM, little frost should occur on the evaporation coils and the evaporation temperature should be predictable. Thus, the measured defrost time at 5 AM will be almost completely the thermal overhead of the defrost process (step 926) without ice. The ideal defrost time for the particular refrigerator is estimated to be the thermal overhead times a factor (step 928) greater than 1. The next defrost is scheduled to occur at 2 AM (step 930) and the program enters the process of FIG. 11.

Figure 10:
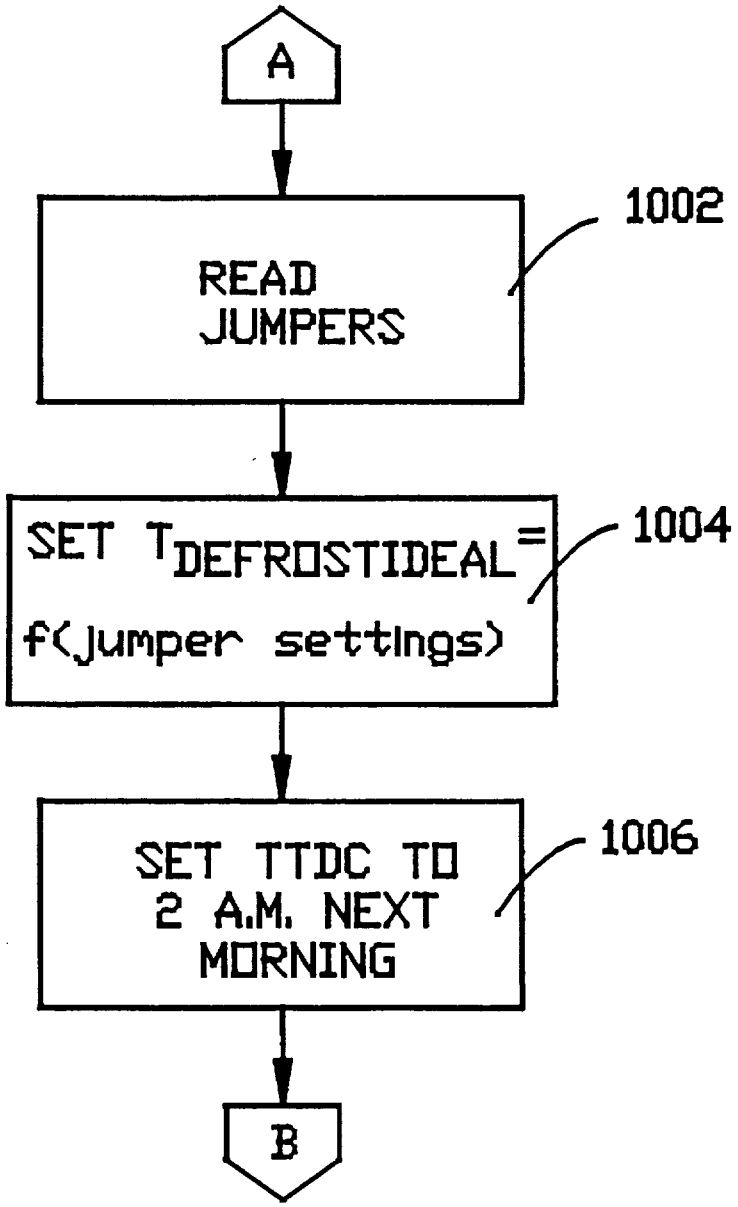

Referring to FIG. 10, an alternate implementation is implemented by reading jumpers (step 1002) which directs the program to read predetermined values of ideal defrost time (step 1004). The TTDC is set to 2 AM (1006) the two calibration defrosts are not required and the program enters the process of FIG. 11.

Figure 11:
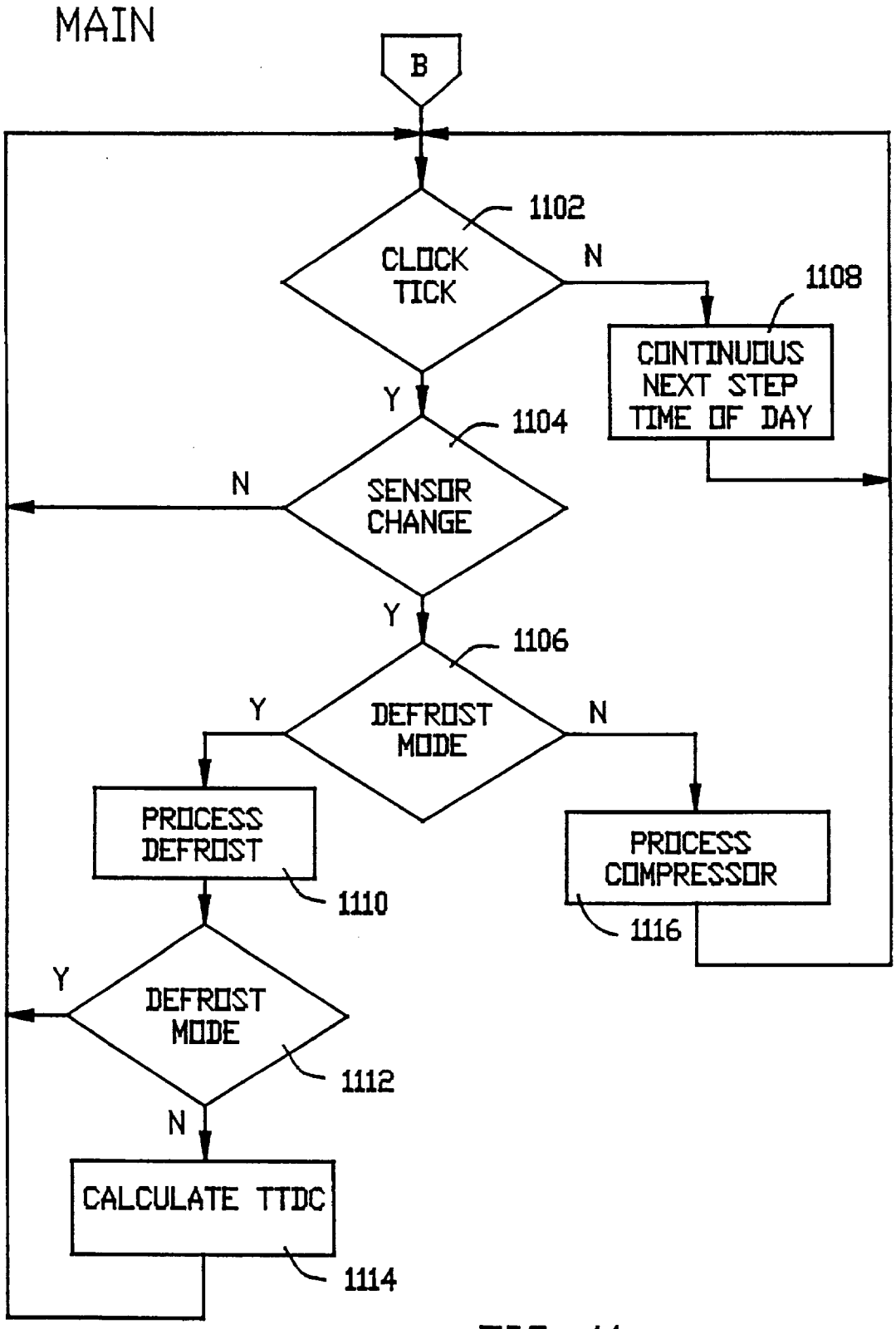
Figure 12:
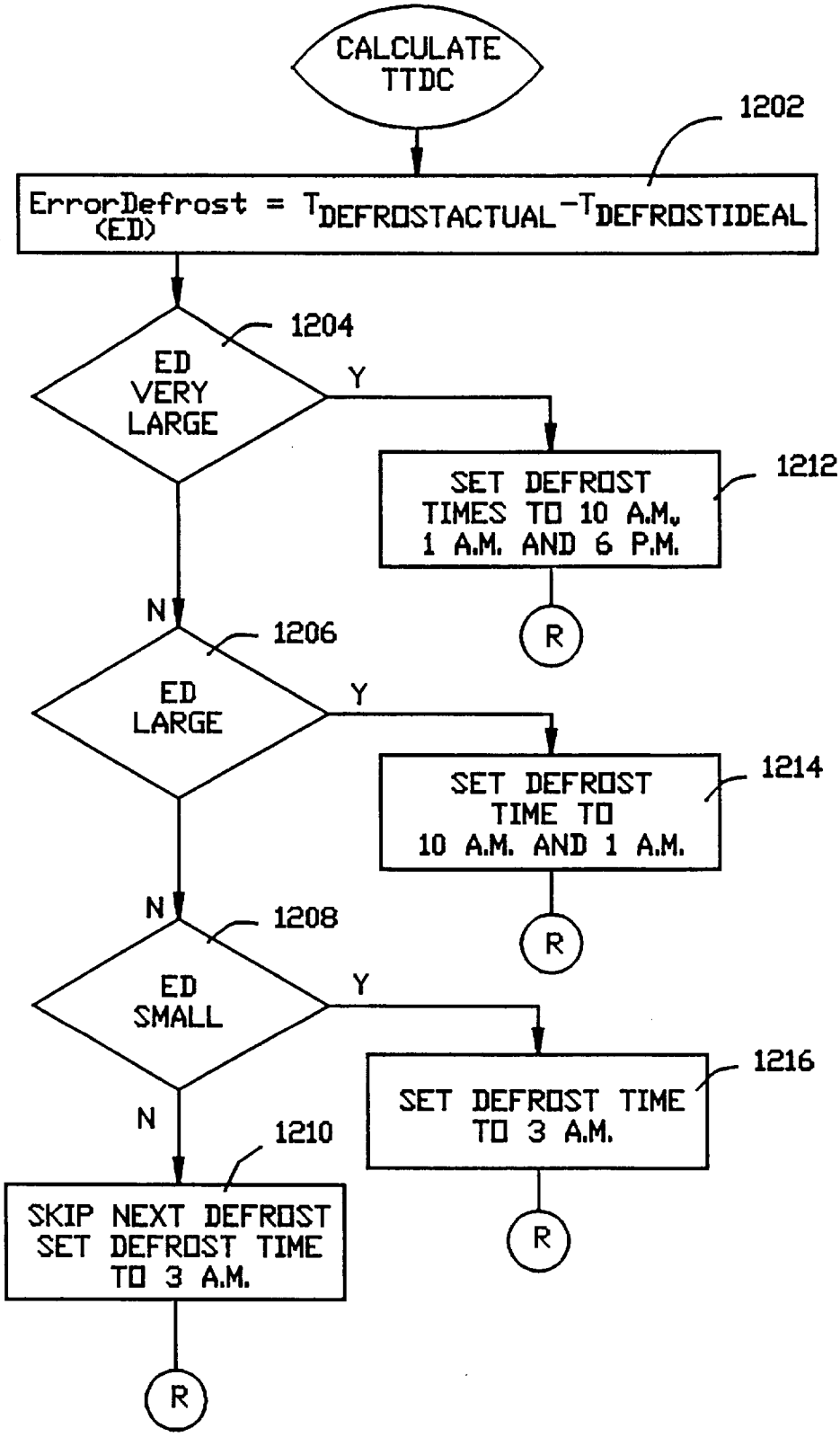

Referring to FIG. 11, the clock tick (step 1102) sensor change (step 104), defrost mode (step 1106), process defrost (step 1110) and process compressor (step 1116) are all similar to those previously described. The TTDC is calculated (step 1114) at the end of each defrost (step 1112). Referring to FIG. 12, the difference between the actual defrost time and ideal time is an error value (ED) (step 1202). If the error value ED is very large (greater than a prescribed value in step 1206), then presumably a lot of ice was on the evaporator coils and three defrosts (step 1212) are required per day. Similarly, if the error is large (step 1206), two defrosts (step 1214) are required per day.

If the error is small (greater than a prescribed value in step 1208), then one defrost is required (step 1216) if the error is less than small (less than a prescribed value in step 1210), then defrost is every other day.

While the invention has been particularly shown and described with reference to the preferred embodiments, it will be understood by those skilled in the art that various modifications in form and detail may be made therein without departing from the scope and spirit of the invention. Accordingly, modifications such as those suggested above, but not limited thereto, are to be considered within the scope of the invention.

What is claimed is:

1. A circuit for determining periodic power consumption of an electrically operated device, which comprises:

(a) measuring means for measuring actual power consumption of said electrically operated device;

(b) control means coupled to said measuring means and operative to enable said measuring means in predetermined first intervals of time;

(c) storage means coupled to said measuring means and operative to store said measured power consumption in at least one second predetermined interval of time; and (d) calculating means for calculating periodic power consumption by an averaging calculation of said measured power consumption stored in said at least one second predetermined interval of time, wherein said calculating means is coupled to said control means for activating and deactivating an electrical component of said electrically operated device.

2. A circuit for determining periodic power consumption as recited in claim 1, wherein said first predetermined interval of time is approximately five seconds and said second predetermined interval of time is approximately twenty-four hours.

3. A circuit for determining periodic power consumption as recited in claim 2, wherein said measuring means includes a toroid transformer associated with an AC switched line voltage supply of said electrically operated device.

4. A circuit for determining periodic power consumption as recited in claim 3, wherein said measuring means further includes a filter and peak detector coupled to said torid transformer.

5. A circuit for determining periodic power consumption as recited in claim 2, further including a microprocessor wherein said microprocessor includes said control means, storage means and determining means.

6. A circuit for determining periodic power consumption as recited in claim 2, further including switching means operative to activate and deactivate an electrically driven component of said electrically operated device upon determination of said periodic power consumption.

7. A circuit for determining periodic power consumption as recited in claim 1, wherein said control means is configured to generate a clock signal with said calculated periodic power consumption through at least means square fit between said clock signal and said calculated power consumption, said clock power being derived in part by said calculated periodic power consumption.

8. A switching circuit for an electrically operated appliance, wherein said switching circuit is responsive to periodic power consumption of said electrically operated appliance, said switching circuit comprises:

a) measuring means for measuring power consumption of said electrically operated appliance in predetermined first intervals of time;

b) storage means coupled to said measuring means and operative to store said measured actual power consumption in a plurality of second predetermined intervals of time;

c) calculating means for calculating said periodic power consumption by an averaging calculation of said measured power consumption stored in said plurality of second predetermined intervals of time; and d) control means coupled to said calculating means and to an electrically driven component of said electrically operated appliance, said control means being adapted to activate and deactivate said electrically driven component upon determination of said periodic power consumption of said electrically operated appliance.

9. A switching circuit as recited in claim 8, wherein said control means is configured to generate a clock signal, said clock signal being derived in part by said calculated periodic power consumption.

10. A switching circuit as recited in claim 9, wherein said control means is further configured to generate said clock signal with said calculated periodic power consumption through at least means square fit between said clock signal and said calculated power consumption.

11. A switching circuit as recited in claim 9, wherein said control means is operative to activate and deactivate said electrically driven component in a prescribed time period defined by said clock signal.

12. A switching circuit as recited in claim 11, wherein said control means includes:

i) a microprocessor;

ii) a solid state relay control circuit coupled to and actuated by said microprocessor; and iii) a relay switching circuit coupled to said solid state relay control circuit, said relay switching circuit further being coupled to said electrically driven component and a power supply, wherein said relay switching circuit is operative to couple said electrically driven component to said power supply upon actuation of said solid state relay control circuit.

13. A switching circuit as recited in claim 12, wherein said measuring means includes a toroid transformer associated with an AC switched line voltage supply of said electrically operated appliance.

14. A switching circuit as recited in claim 13, wherein said measuring means further includes a filter and peak detector coupled to said torid transformer.

15. A switching circuit as recited in claim 14, wherein said storage means and said calculating means are provided in said microprocessor.

16. A switching circuit as recited in claim 15, wherein said first predetermined interval of time is approximately one second and said second predetermined interval of time is approximately twenty-four hours.

17. A method of activating an electrically driven component of an electric appliance in response to measured periodic power consumption of said appliance, which comprises the steps of:

a) measuring power consumption of said appliance in predetermined first intervals of time;

b) storing said measured power consumption in a plurality of second predetermined intervals of time;

c) calculating said periodic power consumption by averaging said measured power consumption stored in said plurality of second predetermined intervals of time;

d) activating said electrically driven component upon determination of said periodic power consumption of said appliance.

18. A method of activating an electrically driven component of an electric appliance as recited in claim 17, further including the step of:

e) generating a clock signal being derived in part by said calculated periodic power consumption.

19. A method of activating an electrically driven component of an electric appliance as recited in claim 18, wherein the activating step (d) activates said electrically driven component in a prescribed time period defined by said clock signal.

20. A method of activating an electrically driven component of an electric appliance as recited in claim 18, wherein activating step (d) generates said clock signal with said calculated periodic power consumption through at least mean square fit between said clock signals and said calculated power consumption.

* * * * *